US009482414B2

(12) United States Patent
Cohade et al.

(10) Patent No.: US 9,482,414 B2
(45) Date of Patent: Nov. 1, 2016

(54) LIGHTING DEVICE

(71) Applicants: Guillaume Cohade, Reims (FR); Quentin Servan, Montrouge (FR); Sebastien Destrigneville, Les Thons (FR); Bruno Daval, Chatillon (FR)

(72) Inventors: Guillaume Cohade, Reims (FR); Quentin Servan, Montrouge (FR); Sebastien Destrigneville, Les Thons (FR); Bruno Daval, Chatillon (FR)

(73) Assignee: MCSMBS, Paris (FR)

( * ) Notice: Subject to any disclaimer, the term of this patent is extended or adjusted under 35 U.S.C. 154(b) by 0 days.

(21) Appl. No.: 14/307,022

(22) Filed: Jun. 17, 2014

(65) Prior Publication Data

US 2015/0016149 A1 Jan. 15, 2015

(30) Foreign Application Priority Data

Jun. 18, 2013 (FR) ..... 13 55694

(51) Int. Cl.
*F21V 15/00* (2015.01)
*F21V 19/00* (2006.01)
(Continued)

(52) U.S. Cl.
CPC ..... *F21V 19/04* (2013.01); *F21S 8/046* (2013.01); *F21V 3/02* (2013.01); *F21V 15/015* (2013.01);
(Continued)

(58) Field of Classification Search
CPC ..... F21V 19/04; F21V 17/10; F21V 23/06; F21V 23/002; F21V 21/02; F21V 21/005; F21V 23/0421; F21S 8/046; H01R 13/6205; H01R 13/7037
USPC ..... 362/646, 219, 221, 222, 217.13, 267, 362/424, 457; 439/39, 38, 180, 188, 218, 439/246, 289
See application file for complete search history.

(56) References Cited

U.S. PATENT DOCUMENTS 4,734,051 A * 3/1988 Burns ..... H01R 13/7036 439/289
5,030,125 A * 7/1991 Toma et al. ..... 439/226
(Continued)

FOREIGN PATENT DOCUMENTS

DE 19820104 A1 * 11/1999
EP 2525131 A1 11/2012
(Continued)

OTHER PUBLICATIONS

Espacenet translation DE19820104 (A1)—Nov. 11, 1999.*
(Continued)

*Primary Examiner* — Anh Mai
*Assistant Examiner* — Arman B Fallahkhair
(74) *Attorney, Agent, or Firm* — Miller, Mathias & Hull LLP

(57) ABSTRACT

The invention relates to a lighting device comprising a light source, a light source support, and a cover that extends longitudinally along a longitudinal axis between a first end and a second end. Each of the first and second ends includes an opening and the light source support is adapted to be moved in part or in full through a said opening. The lighting device also has a closure member for closing at least one of the openings at the first and second ends, the closure member being movable between a closed position and an open position, and a connector (18) having a first connection member and a second connection member. In the closed position of the closure member the first and second connection members are connected together by an electrical contact, which is a butt contact inside the inside space of the cover. The invention also provides a method of taking action on such a device.

10 Claims, 6 Drawing Sheets

(51) Int. Cl.

| | |
|---|---|
| ***F21V 31/00*** | (2006.01) |
| ***F21V 19/04*** | (2006.01) |
| ***F21V 15/015*** | (2006.01) |
| ***F21V 23/06*** | (2006.01) |
| ***F21S 8/04*** | (2006.01) |
| ***F21V 3/02*** | (2006.01) |
| ***F21V 17/10*** | (2006.01) |
| ***F21V 23/00*** | (2015.01) |
| *F21S 2/00* | (2016.01) |
| *F21V 21/005* | (2006.01) |
| *H01R 13/62* | (2006.01) |
| *H01R 33/18* | (2006.01) |
| *F21Y 103/00* | (2016.01) |
| *H01R 13/24* | (2006.01) |
| *H01R 33/96* | (2006.01) |

(52) U.S. Cl.

CPC ..... *F21V 17/10* (2013.01); *F21V 23/002* (2013.01); *F21V 23/06* (2013.01); *F21S 2/00* (2013.01); *F21V 21/005* (2013.01); *F21V 31/00* (2013.01); *F21Y 2103/00* (2013.01); *H01R 13/2421* (2013.01); *H01R 13/6205* (2013.01); *H01R 33/18* (2013.01); *H01R 33/96* (2013.01); *Y10T 29/49117* (2015.01)

(56) References Cited

U.S. PATENT DOCUMENTS

| | | | | |
|---|---|---|---|---|
| 5,088,015 | A * | 2/1992 | Baggio et al. | 362/657 |
| 5,599,090 | A * | 2/1997 | Waldmann | 362/267 |
| 5,702,176 | A | 12/1997 | Engle | |
| 7,513,640 | B2 * | 4/2009 | Hendrikus | 362/219 |
| 8,241,051 | B2 * | 8/2012 | Yi et al. | 439/271 |
| 8,894,419 | B1 * | 11/2014 | Buelow | H01R 13/6205 439/218 |
| 9,080,734 | B2 * | 7/2015 | Andersen | F21L 4/00 |
| 2002/0118537 | A1 * | 8/2002 | Segretto | 362/219 |
| 2006/0291220 | A1 * | 12/2006 | Chen | 362/382 |

FOREIGN PATENT DOCUMENTS

| | | |
|---|---|---|
| FR | 2817945 | 6/2002 |
| WO | WO 2013/009263 A2 | 1/2013 |

OTHER PUBLICATIONS

French Application No. 13 55694 report dated on Feb. 18, 2014.

* cited by examiner

LIGHTING DEVICE

CROSS-REFERENCE TO RELATED APPLICATION

This application claims priority under the Paris Convention to French Patent Application No. 13 55694 filed on Jun. 18, 2013

FIELD OF THE DISCLOSURE

The present invention relates to lighting devices, and in particular to a lighting device for fitting to installations, such as for example for indoor and/or outdoor lighting of buildings, of civil engineering works (bridges, etc.).

BACKGROUND OF THE DISCLOSURE

More particularly, the invention relates to a lighting device comprising:

- a light source;
- a light source support, to which the light source is fastened;
- a cover that extends longitudinally along a longitudinal axis between a first end and a second end, said cover defining an inside space, said light source support and said light source being arranged in the inside space, and each of the first and second ends having a respective opening, the light source support being adapted to be moved in part or in full out from the inside space through a said opening;
- a closure member for closing at least one of the openings at the first and second ends, the closure member being movable between a closed position in which the closure member closes the opening, and an open position in which the closure member does not close the opening; and
- a connector having a first connection member and a second connection member.

Document FR 2 817 945 in the name of the Applicant describes an example of such a lighting device. Lighting devices of that known type are already fitted to buildings.

Nevertheless, that type of lighting device is sometimes situated in a zone that is difficult and/or dangerous to access. For example, lighting devices of that type may be suspended at a height of several meters, which makes access difficult, in particular for performing maintenance operations, such as changing the light source, for example.

In addition, that type of device, advantageously in a sealed version, may also be dedicated to lighting zones that are particular, either in terms of a particular atmosphere (temperatures that are low or high, high levels of dust or humidity, . . . ) or in terms of particular premises to be lighted (particular industrial processes, especially in the agrifood field, or zones having an explosive atmosphere, or secure zones). Under such particular conditions, any action that is taken on the lighting device must be quick and easy to perform, in order to minimize any impact on the temperature, working, or industrial process conditions.

Finally, that type of lighting device can be used in large quantities over huge zones with a high level of lighting (car parks, halls, office spaces, . . . ). In such a configuration, if actions taken on the device are lengthy and laborious, that can have expensive repercussions for the parties involved.

Thus, in order to reduce the length of time spent when taking action on a device of that type, the present invention seeks to improve the device while avoiding any increase in the weight and the price of the device.

SUMMARY OF THE DISCLOSURE

To this end, in the invention, a lighting device is characterized in that the first connection member is arranged in the inside space and the second connection member is provided on the closure member of the first end; in that in the closed position of the closure member, the first and second connection members are electrically connected together by an electrical contact; and in that the electrical contact is a butt contact in the inside space of the cover.

By means of these provisions, it is made easier to separate the closure member electrically from the elements inside the longitudinal cover (in particular the light source and its support), and thus access to those elements is also made easier.

When it is desired to have access to the elements arranged in the inside space of the cover, e.g. by removing the closure member carrying the second connection member from the opening, the present invention makes the operation of electrical disconnection take place simultaneously with the operation of opening the closure member. Likewise, the operation of establishing electrical connection takes place simultaneously with the operation of closing the closure member. In other words, from an operator's point of view, the specific operations of disconnecting and reconnecting the closure members are eliminated since they take place simultaneously with the operations of opening and closing the closure members.

The forces needed for making and breaking connection that are usually required by conventional connection devices using pin-and-socket connections are eliminated by making use of butt electrical contacts.

For example, with devices that are suspended at a height, using a butt electrical contact (i.e. an end-to-end electrical contact) serves to reduce the time required for making the electrical connection. The positions of the connection members on the closure member and in the inside space enable the closure member to be electrically connected with or separated from elements internal to the cover without taking any specific action on the connection members, thereby facilitating taking action on-site directly on the lighting device without it being necessary to remove the lighting device completely. It can thus be understood that an operator needing to act on such a lighting device does not need to take down the entire lighting device (also referred to below as a "lamp") in order to perform the required operation, in particular a maintenance operation or an assembly operation (or indeed any other action of that kind). This is particularly advantageous when the device is difficult of access or high up and the operator is acting with arms in the air, sometimes on a ladder or a stepladder, or indeed when the action needs to be carried out on a large number of lamps.

In preferred embodiments of the invention, it is possible also to have recourse to one and/or more of the following provisions taken singly or in combination:

- in the closed position of the closure member, the first and second connection members are also connected to each other mechanically;
- the first connection member co-operates with the second connection member with resilient mechanical contact. The resilient mechanical contact guarantees that the members connect together cleanly and easily;
- the lighting device also comprises guide elements guiding the closure member relative to the longitudinal cover, the guide elements being formed in part on the light source support. The guide elements make it easy to put the closure member into place, even without good visibility;

the first and second connection members include magnetic elements (e.g. elements made of ferromagnetic material). The magnetic elements provide attraction between the first and second connection members, and consequently ensure that a clean electrical connection is obtained without requiring additional closure forces when the closure member is put into place in the opening of the longitudinal cover. Furthermore, the magnetic elements make connection take place spontaneously under the effect of the magnetic attraction and they also make connection more reliable;

the lighting device further includes an electric power supply cable that, in the closed position of the closure member, is arranged in part outside the inside space and in part inside the inside space, the closure member comprising: an endplate including an orifice having a cable gland (or any other cable-passing device), the power supply cable passing through the endplate through the cable gland (or any other cable-passing device); and a fastener element to which the second connection member is fastened;

the first connection member comprises a distal container, a spring, and a distal body, wherein the distal container extends longitudinally, the spring being housed in the distal container along a spring axis, one end of the spring being fixed relative to the distal container and the other end bearing against the distal body;

the distal body is housed to slide in translation along a distal container axis parallel to the spring axis. The sliding of the distal container ensures that connection takes place without risk of disconnection over the entire length of sliding. This serves in particular to accommodate any slack that might arise over the lifetime of the lighting device. For example, slack might arise between the closure members and internal elements of the cover as a result of them moving relative to one another under the effect of thermal expansion of the various materials used;

an electrical contact element is housed in the distal body;

the second connection member includes a proximal body, and the distal container includes a guide surface for guiding the proximal body. This arrangement serves to reduce the overall size of the connector while providing guidance that is intuitive during connection of the first and second connection members;

the proximal body is secured to the proximal container. For example, it may be secured by snap-fastening, thus making initial installation simple to perform; and an electrical contact element is housed in the proximal body, the electrical contact element of the proximal body and the electrical contact element of the distal body being adapted to be electrically connected together to form the electrical contact.

In addition, the present invention also provides a method of taking action on a device as described above, the method comprising the following steps:

starting from the closed position of the lighting device, electrically disconnecting the first and second connection members by opening the closure member of the first end;

removing the light source support from the inside space;

taking action on the light source and/or on the light source support;

putting the light source support and the light source back into the inside space; and electrically connecting the first and second connection members together by closing the closure member.

For example, the action may consist in a maintenance operation for changing the light source.

In an implementation, the above-described method of taking action further includes a step of guiding and of magnetically attracting the second connection member secured to the closure member relative to the first connection member secured to the light source support inside the cover.

The present invention also provides a method of acting on a device as described above and comprising the following steps:

starting from the closed position of the lighting device, opening the closure member of the second end and electrically disconnecting the first and second connection members by moving the light source support in part or in full out from the inside space through the opening of the second end;

taking action on the light source and/or on the light source support;

putting the light source support and the light source back into the inside space;

electrically connecting the first and second connection members together by putting the light source support and the light source into position in the inside space; and closing the closure member of the second end.

Other characteristics and advantages of the invention appear from the following description of an embodiment of the invention, given by way of non-limiting example and with reference to the accompanying drawings.

In the various figures, the same references designate elements that are identical or similar.

DETAILED DESCRIPTION OF THE DISCLOSURE

Figure 1:
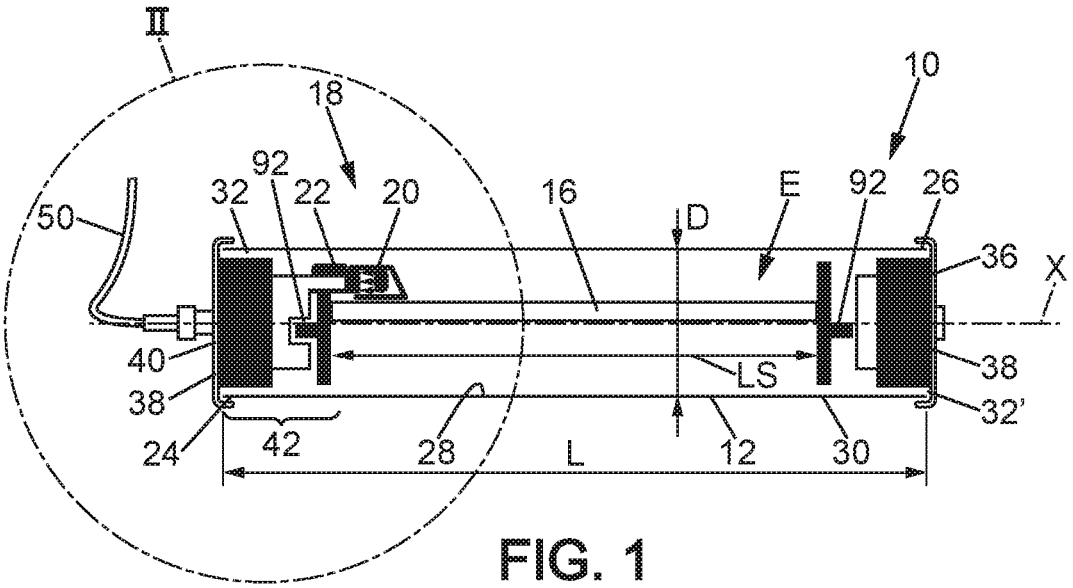
FIG. 1 is a diagrammatic longitudinal section view of a lighting device of the invention, the closure member being in the closed position.

FIG. 1 shows a lighting device 10 of the invention. The lighting device 10 has a cover 12. A light source 14 (cf. FIG. 2) is arranged in association with a light source support 16 inside the cover 12. The light source 14 is electrically powered by a connector 18 having a first connection member 20 and a second connection member 22.

As shown in FIG. 1, the cover 12 is longitudinal. The cover 12 extends along a longitudinal axis X between a first end 24 and a second end 26. The cover 12 is preferably cylindrical in shape, e.g. in the form of a circular section tube with an outside diameter D and a length L along the longitudinal axis X, as shown in FIG. 1. By way of example, the outside diameter of the cover lies in the range 40 centimeters (cm) to 133 cm, and is preferably about 70 cm, and its length lies in the range 50 cm to 200 cm. Nevertheless, in various embodiments, the cover 12 may be of square section tubular shape, or indeed the cover 12 may have a shape that is not tubular.

By way of example, the cover 12 is made of a material that is transparent and/or translucent. For this purpose, the cover 12 may be made of a material such as transparent and/or translucent plastics material or glass. The cover 12 is optionally made of a translucent material allowing light to pass through without being totally transparent. The cover may optionally be made of two materials, one of them being opaque, e.g. aluminum, and the other being transparent and/or translucent.

The cover 12 defines an inside space E that extends between the first and second ends 24 and 26 of the cover 12. The cover 12 also has an inside surface 28 facing towards the inside space E and an outside surface 30, opposite from the inside surface 28.

At its first end 24, the cover 12 has a first opening 32. At its second end 26, the cover 12 preferably has a second opening 32'. The second opening 32' of the cover 12 is closed by an endplate, specifically a distal endplate 36. Specifically, the distal endplate 36 is releasably fastened on the second end 26 of the cover. A locking member is associated with the distal endplate 36 to lock or secure it in its closed position. For example, a nut or a bolt may be used. Specifically, it is possible to use a butterfly nut type that is incorporated in the distal endplate. Nevertheless, in variant embodiments, any other locking member may be used, preferably one that does not require a tool, e.g. a latch or a pivotal handle.

By way of example, the distal endplate 36 is circular. The distal endplate 36 may be made of metal material, for example. Nevertheless, it is possible to envisage using a plastics material. Advantageously, the assembly between the distal endplate 36 and the cover 12 is sealed in the closed position. For this purpose, a sealing gasket may be provided. The assembly of the distal endplate on the cover may optionally be an assembly that is permanent, in which case it may be provided by adhesive, welding, riveting, or any other known assembly means.

At its first end 24, the cover 12 also has a closure member 38. The closure member 38 is movable between a closed position in which it closes the inside space E of the cover 12, and an open position in which the inside space E of the cover 12 is accessible from outside the lighting device via the first end 24 of said lighting device. In other words, the closure member 38 is fastened in releasable (or detachable) manner on the second end 24 of the cover 12.

The closure member 38 includes an endplate, specifically a proximal endplate 40. In the closed position of the proximal endplate 40 (or in other words in the closed position of the closure member 38), the inside space E of the cover 12 is not accessible from the outside of the lighting device via the first end 24 of said lighting device. Advantageously, the assembly between the closure member 38 and the cover 12 is a sealed assembly. For example, the closure member 38 includes a portion 42 adapted to be arranged in the inside space E of the cover 12 when the closure member 38 is in the closed position. For this purpose, a sealing member, e.g. a sealing gasket 44, is associated with the portion 42 and provides sealing between the cover 12 and the closure member 38. More precisely, the sealing gasket 44 provides sealing in the proximity of the first end 24 between the inside surface 28 of the cover 12 and the closure member 38.

Figure 2:
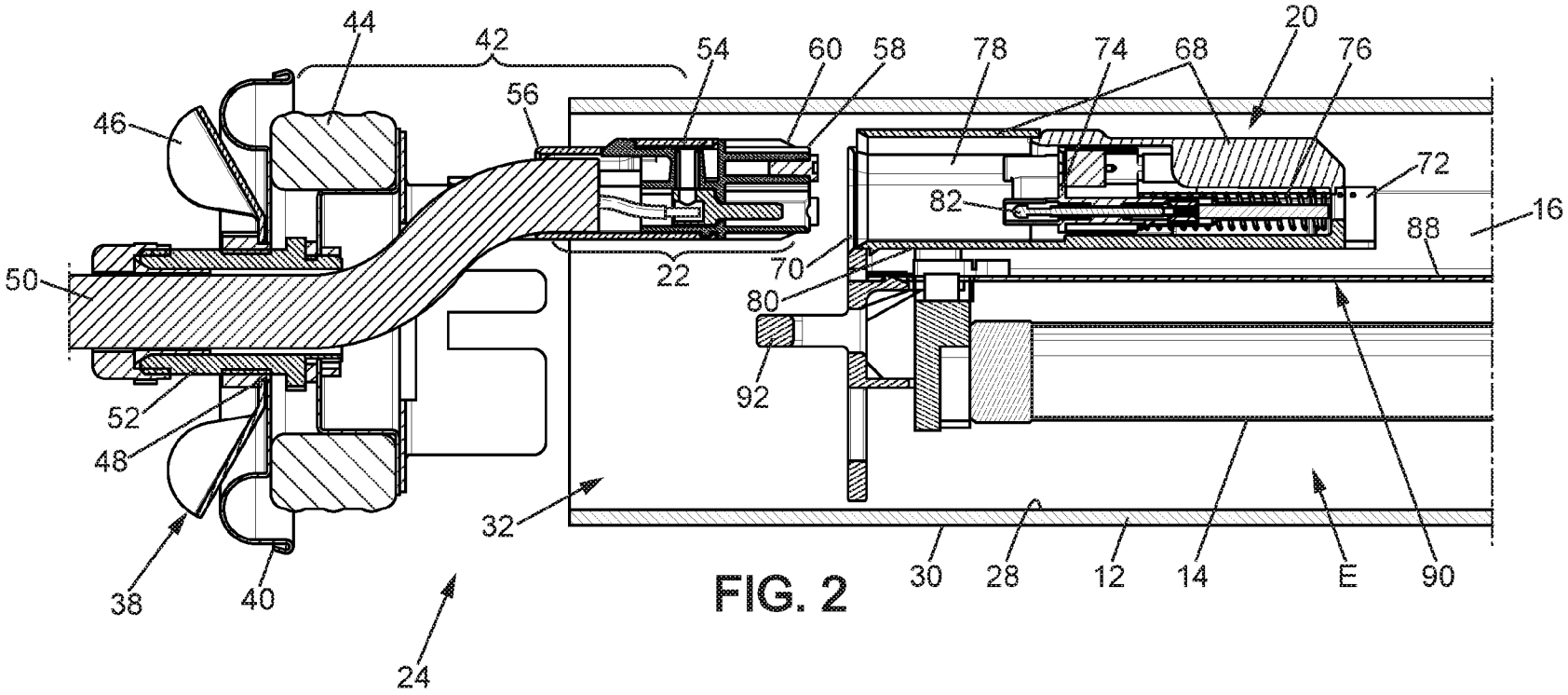
FIG. 2 is a longitudinal section view on a larger scale showing a zone referenced II in FIG. 1, the closure member being in the open position.

Specifically, a locking member 46 is associated with the proximal endplate 40 to lock or secure it in the closed position of the closure member 38. For example, a nut or a bolt may be used. Specifically and as shown in FIG. 2, it is possible to use a butterfly nut type locking member 46 that is integrated in the proximal endplate. Nevertheless, in variant embodiments, any other locking member, preferably one that does not require a tool, may be used, e.g. a latch or a pivotal handle.

The proximal endplate 40 is provided at its center with an orifice 48 adapted to pass an electric power supply cable 50. Specifically, and as shown more clearly in FIG. 2, a cable gland 52 is arranged in part in the orifice 48 and in part around the orifice 48, and the electric power supply cable 50 passes through the proximal endplate 40 via the cable gland 52. In other words, the cable gland 52 allows the electric power supply cable 50 to pass through the closure member 38 from outside the cover to the inside space E of the cover 12. The presence of the cable gland 52 serves to guarantee sealing of the cover 12.

In a variant embodiment, the cable gland 52 may be replaced by some other cable-passing device, e.g. merely by a tight grommet or by an electrical connection, e.g. an unpluggable outdoor receptacle that is provided on the endplate instead of the cable gland.

Figure 3:
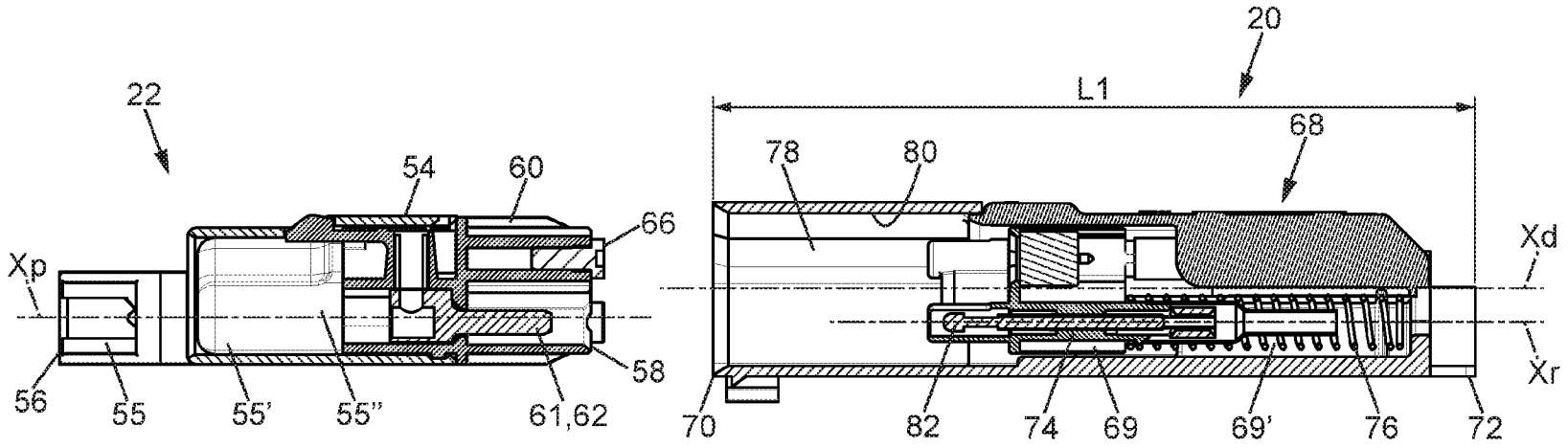
FIG. 3 is a section view in the open position of the connector forming part of the FIG. 2 lighting device.

The proximal endplate 40 is associated with the second connection member 22 of the connector 18. Specifically, the closure member 38 (also referred to as a closure element 38) associated with the proximal endplate 40 includes a fastener element to which the second connection member 22 is fastened. The connection member 22, as shown in FIG. 3, extends in particular along a proximal body direction Xp between a first end 56 and a second end 58. The first end 56 is directed towards the proximal endplate 40, while the second end 58 is directed towards the distal endplate 36. More precisely, the second connection member 22 is made up of a proximal container 54 and of a proximal body 60. By way of example, the proximal container 54 and the proximal body 60 are made of a plastics material, in particular by molding. The proximal container 54 has a plurality of housings 55, 55', and 55".

More precisely, the proximal body 60 is arranged in a housing 55" of the proximal container 54. The proximal body 60 is preferably secured to the proximal container 54 by snap-fastening. In other words, a fastener clip holds the proximal body 60 secured to the proximal container 54. Nevertheless, in variant embodiments, the proximal body 60 may be assembled to the proximal container 54 by other assembly methods and/or elements.

A free end of the electric power supply cable 50 is received in the second connection member 22, and more precisely in a housing 55' of the proximal body 60.

Figure 5:
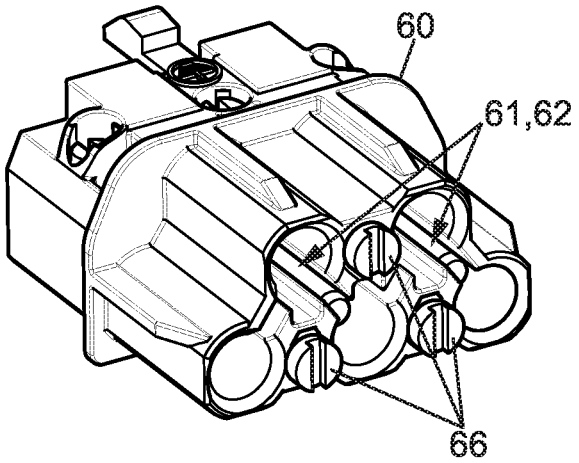
FIG. 5 is a perspective view of a proximal body of a second connection member of the FIG. 1 lighting device.

The second connection member 22, and more particularly the proximal body 60 includes an electrical contact element 61. The electrical contact element 61 of the second connection member 22 may comprise a plurality of pins 62, for example. Specifically, and as shown in FIGS. 3 and 5, the electrical contact element 61 of the second connection member 22 has five pins with plane terminations and screw terminals for electrically connecting the second connection member 22 to the electric power supply cable 50, and more precisely for electrically connecting the proximal body 60 to the electric power supply cable 50. More particularly, the electric power supply cable 50 has a plurality of electric wires, and each pin 62 is associated with an electric wire or a set of electric wires.

The second connection member 22 preferably also includes one or more metal inserts 66 that are magnetic or ferromagnetic (and optionally electromagnetic), e.g. flat head screws or nails. The metal insert(s) 66 advantageously projects a little from the second end 58 of the second connection member towards the distal endplate 36. The term "projecting a little" should be understood as projecting by millimeter order.

The second connection member 22 is adapted to be assembled to the first connection member 20 so as to form the connector 18. The connector 18 preferably has a total length L18 of the order of 98 millimeters (mm) and a height h of the order of 16 mm.

The first connection member 20 has a distal container 68. The distal container 68 is preferably assembled on the light source support 16 arranged in the inside space E of the cover 12. The distal container 68 is made of non-conductive material, e.g. a plastics material. The distal container 68 is preferably made by molding. The distal container 68 receives a distal body 74 and a spring 76.

The distal container 68 has a plurality of housings 69, 69'. The distal container 68 extends in a distal container direction Xd between a first end 70 and a second end 72. The first end 70 faces towards the proximal endplate 40, while the second end 72 faces towards the distal endplate 36. In the distal container direction Xd, the distal container 68 has a length L1.

The spring 76 is housed in a housing 69' of the distal container 68 along a spring axis Xr. Advantageously, the spring axis Xr is parallel to the distal container direction Xd. The spring 76 is received entirely inside the distal container 68 and it extends substantially between the second end 72 opposite to the distal container 68 and the center of the distal container 68.

The distal body 74 is housed in a dedicated housing 69 of the distal container 68. In other words, the distal container 68 preferably surrounds the distal body 74 completely. The distal body 74 is movable in translation in its housing along an axis parallel to the distal container direction Xd. The distal body 74 presses against the spring 76. More precisely, at least a portion of the distal body 74 presses against the spring 76. The spring 76 exerts a force directed along the spring axis direction Xr on a portion of the distal body 74. The distal body 74 is made of plastics material. Nevertheless, other types of material could be envisaged.

As shown in FIG. 3, the distal body 74 is held halfway along the distal container 68 by the spring 76, which is preferably a compression spring. In other words, the distal body 74 is situated substantially between the first end 70 and the second end 72 of the distal container 68.

In the vicinity of its first end 70, and upstream from the distal body 74, the distal container 68 includes a connection duct 78 that has a guide surface 80.

Figure 6:
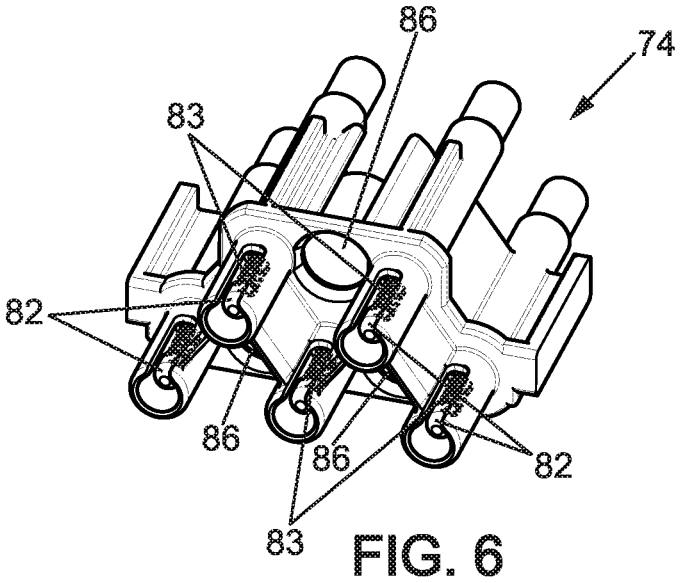
FIG. 6 is a perspective view of a distal body of a first connection member of the FIG. 1 lighting device.

The distal body 74 has an electrical contact element 82. As shown in FIGS. 3 and 6, the electrical contact element 82 is made up of a plurality of electrical contacts 83. The electrical contacts 83 are mounted on springs. For example, the distal body 74 has five electrical contacts 83 mounted on springs (also known as spring contacts). The springs allow the electrical contacts 83 to move along the distal container direction Xd.

The spring electrical contacts 83, also known as "butt" contacts, ensure good electrical contact over small areas and are fitted with internal springs to improve electrical contact performance by the pressure they exert on the contact. Furthermore, by its very design, this type of contact presents the advantage of being capable of accommodating small movements of the parts without electrical disconnection, i.e. movements of millimeter order.

In addition, and as shown in FIG. 6, the distal body 74 may include magnetic means. For example, the distal body 74 includes magnets 86. As shown in FIG. 6, the distal body 74 has three cylindrical magnets 86 that extend along the distal container direction Xd. The cylindrical magnets 86 are housed in the distal body 74 between the electrical contacts 83.

As described above, the second connection member 22 is for associating with the first connection member 20. In order to make the electrical and mechanical connection between the first connection member 20 and the second connection member 22, the proximal body 60 secured to the proximal container 54 needs to be inserted in the connection duct of the distal container 68. The dimensions of the distal container 68 and of the second connection member 22 are such that the proximal body 60 can be inserted in the connection duct 78 of the distal container 68 without effort.

The proximal body 60 is inserted in the distal container 68 until the proximal body 60 comes into abutment against the distal body 74. More precisely, the proximal body 60 is guided by the guide surface 80 in the distal container 68 along the distal container direction Xd up to an abutment surface corresponding to the distal body 74. When the proximal body 60 is in contact with the distal body 74, each electrical contact of the proximal body 60 is in contact with an associated electrical contact 82 of the distal body 74 so that electricity can pass between the electric power supply cable 50 and the first connection member 20, itself associated with the light source support via the second connection member 22. In other words, during insertion of the proximal body 60 into the distal container 68, the pins 62 of the proximal body 60 come into co-operation with the spring contacts 83 of the distal body 74, thereby establishing electrical contact. The electrical contact elements 61, 82 co-operate in abutment and thus provide an electrical connection directly as soon as they come into surface-on-surface contact one on the other.

A force of attraction is generated between the magnets 86 on the distal body 74 and the metal inserts 66 on the proximal body 60. The force of attraction contributes to guiding the proximal body 60 towards the distal body 74 and to establishing a reliable connection between the first connection member 20 and the second connection member 22. The magnets 86 are dimensioned so that immediately before contact is made between the pin 62 and the corresponding spring contact 83, the force of attraction of the magnets 86 on the metal inserts 66 is slightly greater than the sum of the compression forces of the spring contacts 83.

In variant embodiments, the first connection member 20 and the second connection member 22 need not have metal inserts and magnets. Furthermore, it is possible to provide a compression spring other than the above-mentioned spring 76, likewise housed in the distal container 68 and dimensioned so as to exert a pressure from the distal body 74 on the proximal body 60 such that, once the closure member is in the closed position, the proximal body 60 is held against the distal body 74, and thus it is ensured that electrical contact is maintained. In another variant, a snap-fastener device may be provided, e.g. inside the distal container 68 in order to block the proximal body 60 mechanically in the distal container 68.

The first connection member 20 is fastened on the light source support 16. As shown in FIGS. 1 and 2, the light source support 16 has a first surface 88 and a second surface 90 opposite from the first surface 88. The light source 14 is arranged or assembled on the second surface 90, possibly via dedicated connection elements (sockets for fluorescent tubes, for example). The first connection member 20 is fastened to the first surface 88 so as to avoid obstructing or reducing the light field produced by the light source 14. More precisely, the first connection member 20 is fastened on the first surface 88 of the light source support 16 close to the second end 26. For example, the first connection member 20 is mechanically assembled on the light source support 16 by snap-fastening. In variant embodiments, the first connection member 20 is assembled on the light source support 16 by screws or by any other assembly means. In a variant made in a longitudinal cover of small diameter, e.g. not suitable for positioning the connection member 20 on a surface opposite from the surface on which the light source is fastened, the first fastener member 20 may be assembled to the end of the light source support 16 in a zone dedicated to making connections, the lighting portion of the lamp beginning only beyond this zone.

As shown, the light source support 16 extends longitudinally along the longitudinal axis X. The light source support 16 has a length LS that is less than the length of the longitudinal cover L, so as to be capable of being received entirely in the inside space E of the cover. For example, the light source support 16 is provided with a grip handle 92, or as shown with two grip handles 92, making it easy to remove the light source support 16 from the inside space E of the cover 12. In particular when acting on the lamp, and more particularly when performing a maintenance operation, this characteristic can be particularly advantageous. In addition, guide rails may be provided in the inside space E of the cover for guiding the light source support 16.

Specifically, in the closed state of the lighting device 10, the proximal container direction Xp, the distal container direction Xd, the longitudinal axis direction X, and the spring axis direction Xr are all substantially parallel.

The light source 14 is advantageously a source of elongate shape. Specifically, the longitudinal cover protecting the source is often subjected to large amounts of thermal expansion. More precisely, the cover 12 of the lamp, which is often made of plastics material, may lengthen or retract as a function of temperature conditions relative to the lamp that are internal (its own heating) and external (utilization conditions), and it may do so to a greater extent than the internal structure, and in particular than the light source support, which is advantageously made from metal sheet. The clearance between the light source support and the proximal endplate, and consequently between the first connection member 20 and the second connection member 22 can thus fluctuate over the time the lamp is on and/or over the lifetime of the device when it is subjected to strong temperature gradients. The stroke of the spring 76 can compensate for any thermal expansion due to using the lighting device. Thus, the force exerted by the spring on the proximal body 60 serves to eliminate any risk of unwanted electrical disconnection between the first connection member 20 and the second connection member 22.

The lighting device 10 is simple to install, and any maintenance or other action can be performed thereon simply.

In particular, the device can be installed in two steps: connecting the second connection member 22; and then closing the lamp, which is made easier by automatic connection, i.e. connection that takes place simultaneously with the action of closing the lamp and spontaneously via the butt contacts.

The step of connecting the second connection member 12 takes place as follows: firstly, the electric cable 50 is passed through the cable gland 52 and into the opening 55' of the proximal container 54, which may be separated easily from the proximal endplate 40 so as to make it easier to pass the cable 50. Secondly, the wires of the cable that have had their ends stripped previously are connected in the screw terminals 62 of the proximal body 60. Thirdly, the proximal body 60 is secured to the proximal container 54 and then the assembly is mounted on the dedicated support of the proximal endplate 40. The cable gland 52 is then tightened around the cable to seal the cable passage.

The step of closing the lamp is performed as follows: the closure member 38 is approached so as to position the proximal body 60 of the second connection member 22 facing the opening of the duct of the distal container 68. The movement in translation while closing the closure member 38 up to the locked position gives rise to electrical connection between the first connection member 20 and the second connection member 22 of the connector 18. Thereafter, the closure member is locked in the closed position.

FIGS. 4A to 4D show more precisely how connection is made between the first connection member 20 and the second connection member 22.

Figure 4A:
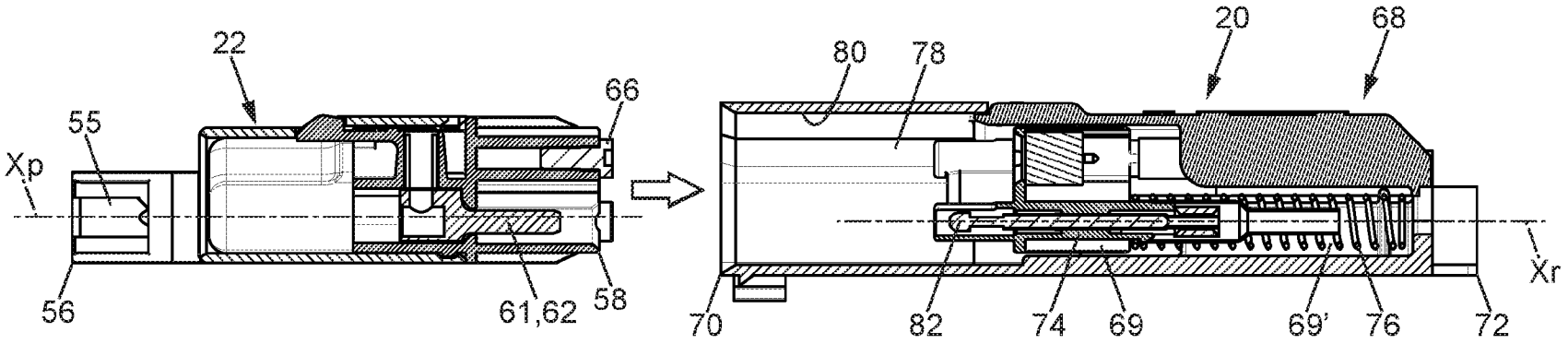
FIGS. 4A to 4D are figures showing steps in connecting the connector of FIG. 3.
Figure 4B:
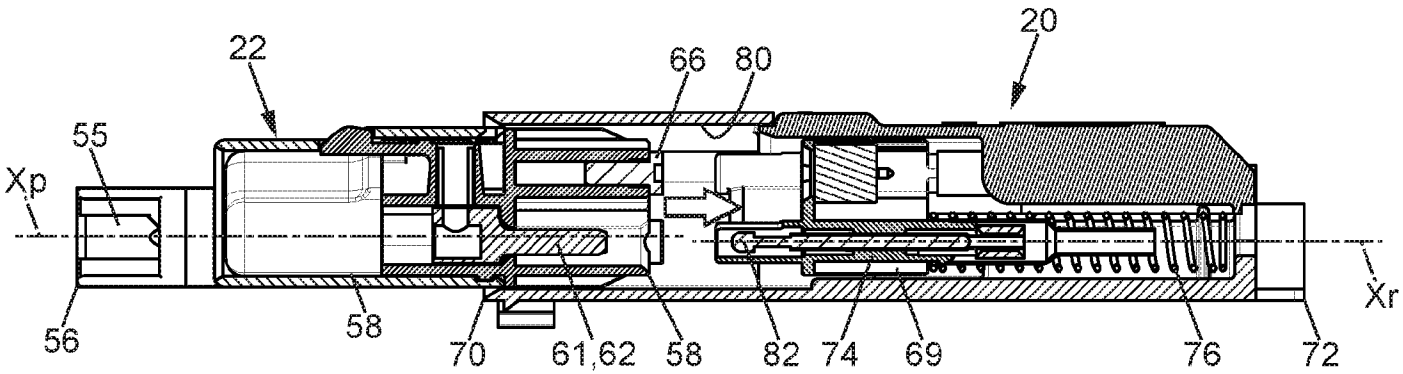

As shown in FIGS. 4A and 4B, when the second connection member 22 is caused to approach the first connection member 20, the proximal body 60 of the second connection element 22 is received in the connection duct 78 of the distal container 68. The proximal body 60 is guided in the connection duct 78 by the guide surface 80.

Figure 4C:
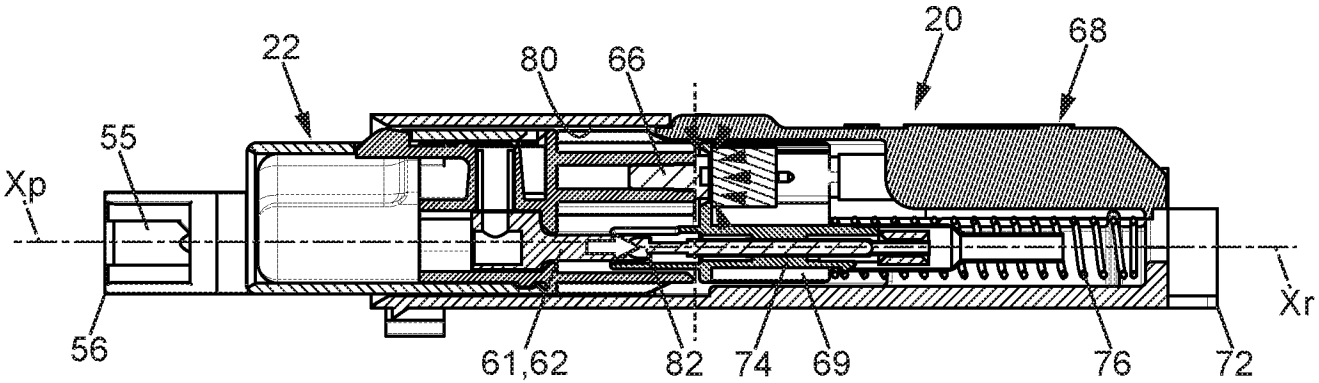
Figure 4D:
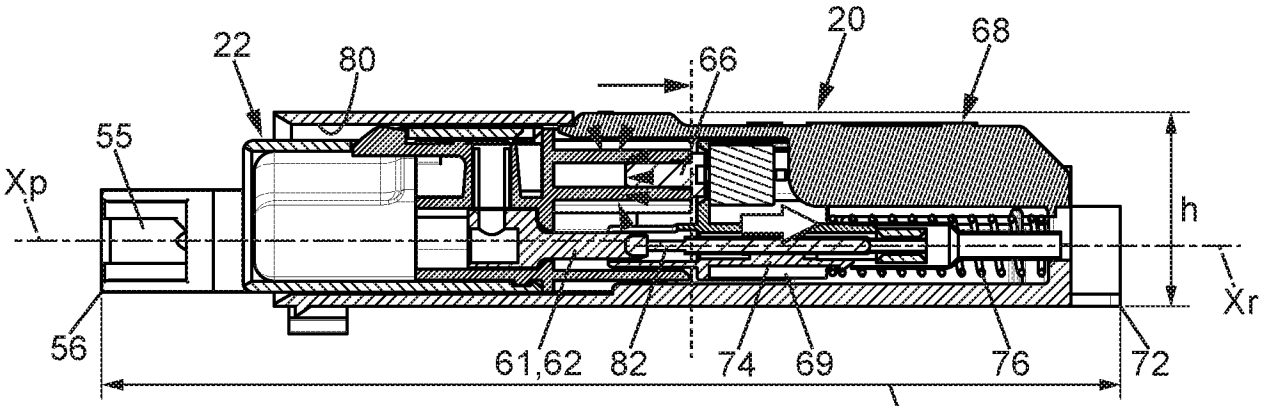

Under the effect of attraction from the magnets 86, the first and second connection members are attracted towards each other and electrical connection is established, as shown in FIG. 4C.

During closure of the closure member 38, the proximal body 60 comprises the distal body 74 of the first connection member 20. The spring 76 is then compressed, and the distal body 74 moves in translation along the distal container direction Xd towards the second end 72 of the distal container 68. This configuration ensures that the spring 76 is compressed and consequently that a constant thrust force is applied to the distal body 74 towards the proximal body 60. This secures the electrical connection.

In addition, in order to act on the device, e.g. in order to perform a maintenance operation for changing the light source 14, an operator proceeds with a succession of steps that are simple to perform, without any special tooling (other than a tool for unlocking the proximal and distal endplates, should that be necessary), and without risk of damaging the device.

From a closed position of the lighting device 10, or in other words from the closed position of the proximal and distal endplates 40 and 36 on the cover 12, the operator opens the closure member 38 at the second end 26. For example, the operator unlocks the closure member. By performing a movement along the longitudinal axis X away from the proximal endplate 40 of the cover 12, the operator withdraws the closure member 38 at least in part from the second opening 32'. Withdrawal of the closure member 38 gives access to the inside space E, and among other things makes it possible to access the light source 14 and its support 16. Specifically, the light source support includes the grip handle 92 that enables the light source support to be withdrawn from the inside space E and/or enables the light source support 16 to be moved in translation in the inside support away from the proximal endplate 40 along the longitudinal axis X. The description relates to taking action on the end opposite from the connector, i.e. action taken on the distal endplate. The movement in translation is thus away from the proximal endplate 40. Withdrawing the light source support 16 from the inside space E and/or moving it in translation in the inside space E away from the proximal endplate 40 substantially along the longitudinal axis X leads to the first connection member 20 becoming electrically disconnected from the second connection member 22 of the connector 18. More precisely, withdrawing and/or moving the light source support 16 in translation in the inside space E away from the proximal endplate 40 substantially along the longitudinal axis X leads to the first connection member 20 moving in translation along the longitudinal axis X, and consequently to the distal container 68 moving along the longitudinal axis X away from the proximal endplate 40. The first connection member 20 thus moves away from the second connection member 22. Moving the first connection member 20 in translation thus leads to its electrical contact element 82 being decoupled from the electrical contact element 61 of the second connection member 22.

In a variant embodiment, the closure member 38 in the open position may be mechanically connected to the cover 12, e.g. by means of a cable or a strap.

In a variant, e.g. when the distal endplate 36 is not removable, it is possible in a first step, starting from a closed position of the lighting device 10, or in other words starting from the closed position of the closure member 38 on the cover 12, for the operator to open the closure member 38 associated with the first end 24. For example, the operator unlocks the closure member 38. By performing a movement along the longitudinal axis X away from the distal endplate 36 of the cover 12, the operator withdraws the closure member 38 at least in part from the first opening 32. The at least partial withdrawal of the closure member 38 leads to the first connection member 20 being electrically disconnected from the second connection member 22 of the connector 18. More precisely, withdrawing the closure member 38 from the opening leads to the second connection member 22 moving in translation along the longitudinal axis X, with the second connection member 22 thus moving away from the first connection member 20. Thus, movement in translation of the second connection member 22 leads to its electrical contact element 82 becoming decoupled from the electrical contact element 61 of the second contact member 22.

It is then possible to access the light source support by causing the light source support to slide out from the inside space E by using the grip handle 92. The lighting device is subsequently reclosed by replacing the light source support in the inside space and then reclosing the closure member 38.

It can be seen that there is never any need to loosen the cable gland in order to act on the lighting device. Without the present invention, it is sometimes necessary to perform an operation of loosening the cable gland before closing the lamp: by releasing the cable the operator can move the proximal endplate away from the cover of the lamp, and can manually reconnect the power supply cable to the internal support.

Since the reconnection operation in the present invention is automatic, the cable gland is closed once and forever while the lighting device is being installed, thereby greatly contributing to guaranteeing that sealing is preserved.

The lighting device 10 may be provided on its own, as described above, or else it may be covered in series with a second lighting device of the same type.

Figure 7:
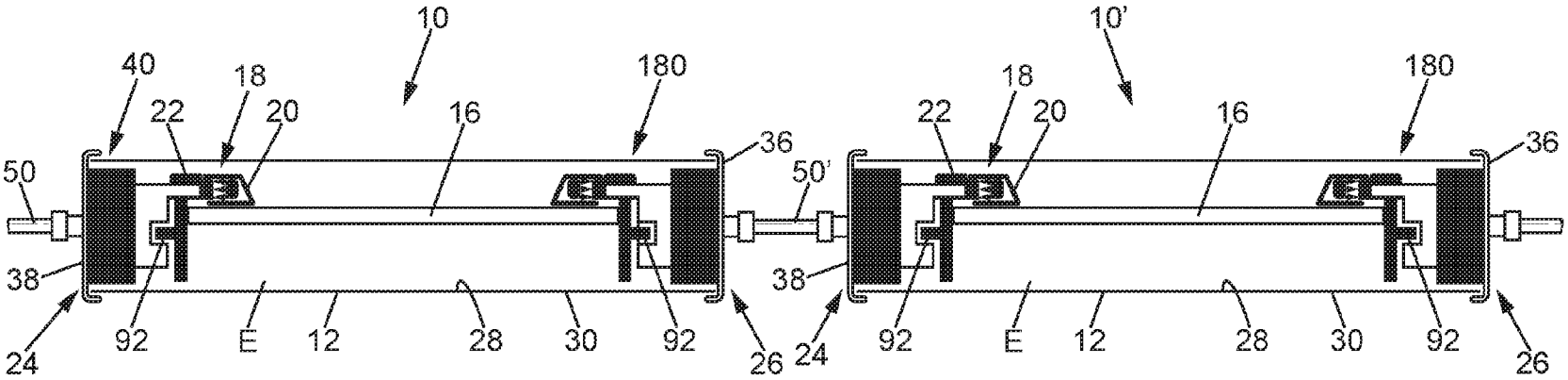
FIG. 7 is a diagrammatic longitudinal section view of two lighting devices of the invention that are coupled together.

As shown in FIG. 7, the lighting device 10 may be electrically connected in series with another lighting device 10' that is similar to the lighting device 10. Nevertheless, in variant embodiments, the lighting device may be associated in series with a plurality of lighting devices. As shown in FIG. 7, the distal endplate 36 is similar to the above-described proximal endplate and a second connector 180 similar to the connector 18 is provided in the proximity of the second end 26 of the cover. The lighting device can thus advantageously be entirely symmetrical. A second electric power supply cable 50' extends out from the inside space E of the lighting device 10 via the second end 26 and is connected directly to the second device 10'.

When taking action on a device, such as a maintenance operation, e.g. for the purpose of replacing the light source in one of the lighting devices, it is necessary only to disconnect the faulty lighting device electrically and possibly also mechanically, in the manner described above. The fact that the lamp is disconnected automatically on being opened guarantees that any action taken thereon, e.g. a maintenance operation, is performed while the lamp is dead, even if the operator has not taken care to switch off the power supply to the affected lamp. This provides additional safety when handling lamps.

Furthermore, the present device has the advantage of ensuring that sealing is long-lasting. Since the device is coupled in series with a plurality of other lighting devices, each of its two closure members 38 has a cable 50 passing therethrough. When taking action on the device, one of the two closure members 38 needs to be withdrawn in order to clear the opening of the cover and give access to the internal members. Withdrawal of the closure member 38 is made easier by the presence of the connection device as described. Once the faulty part has been replaced, the closure member needs to be reclosed, and this is likewise made easier by the device of the present invention. Without the invention, reconnecting the closure member needs to be performed manually by the operator and that can sometimes lead to the cable gland being loosened in order to allow the endplate to slide along the cable away from the body of the lamp. In prior systems, that runs the risk of sealing being lost, in particular since operators are not always diligent. It is not always guaranteed that the cable gland is properly retightened so as to ensure that the closure is properly sealed. In addition, when a cable clamp is loosened after being tight for several years, the cable has been bitten into (i.e. damaged) and good practice consists in cutting back the cable to the bitten (or damaged) portion and performing once again the entire connection operation as was performed by the installer during installation. Unfortunately, few operators take the trouble to perform these tasks.

Thus, the device of the invention is particularly advantageous and enables those drawbacks to be remedied.

The invention claimed is:

1. A lighting device comprising:

a light source;

a light source support, to which the light source is fastened;

a cover that extends longitudinally along a longitudinal axis between a first end and a second end, said cover defining an inside space, said light source support and said light source being arranged in the inside space, and each of the first and second ends having a respective opening, the light source support being adapted to be moved in part or in full out from the inside space through said opening;

a closure member for closing at least one of the openings at the first and second ends, the closure member being movable between a closed position in which the closure member closes the opening, and an open position in which the closure member does not close the opening; and a connector having a first connection member and a second connection member;

the device being characterized in that the first connection member is arranged in the inside space and the second connection member is provided on the closure member of the first end;

in that in the closed position of the closure member, the first and second connection members are electrically connected together by an electrical contact; and in that the electrical contact is a butt contact in the inside space of the cover, wherein the first connection member comprises a distal body movable along the longitudinal axis, the distal body comprises an electrical contact element composed of electrical contacts, each electrical contacts being mounted on an internal spring in order to ensure the butt contact, and wherein the device comprises a spring, the distal body being pressed against the spring.

2. A lighting device according to claim 1, wherein the first connection member comprises a distal container, a spring, and a distal body, wherein the distal container extends longitudinally, the spring being housed in the distal container along a spring axis, one end of the spring being fixed relative to the distal container and the other end bearing against the distal body, wherein the distal body is housed to slide in translation along a distal container axis parallel to the spring axis, and wherein an electrical contact element is housed in the distal body.

3. A lighting device according to claim 2, wherein the second connection member includes a proximal body, and the distal container includes a guide surface for guiding the proximal body.

4. A lighting device according to claim 3, wherein an electrical contact element is housed in the proximal body, the electrical contact element of the proximal body and the electrical contact element of the distal body being adapted to be electrically connected together to form the electrical contact.

5. A lighting device according to claim 1, wherein, in the closed position of the closure member, the first and second connection members are also connected to each other mechanically, and wherein the first connection member co-operates with the second connection member with resilient mechanical contact.

6. A lighting device according to claim 1, wherein the first and second connection members include magnetic elements.

7. A lighting device according to claim 1, further including an electric power supply cable that, in the closed position of the closure member, is arranged in part outside the inside space and in part inside the inside space, the closure member comprising:

an endplate including an orifice having a cable gland, the electric power supply cable passing through the endplate through the cable gland; and a fastener element to which the second connection member is fastened.

8. A method of acting on a lighting device comprising:

a light source;

a light source support, to which the light source is fastened;

a cover that extends longitudinally along a longitudinal axis between a first end and a second end, said cover defining an inside space, said light source support and said light source being arranged in the inside space, and each of the first and second ends having a respective opening, the light source support being adapted to be moved in part or in full out from the inside space through a said opening;

a closure member for closing at least one of the openings at the first and second ends, the closure member being movable between a closed position in which the closure member closes the opening, and an open position in which the closure member does not close the opening; and a connector having a first connection member and a second connection member;

the device being characterized in that the first connection member is arranged in the inside space and the second connection member is provided on the closure member of the first end;

in that in the closed position of the closure member, the first and second connection members are electrically connected together by an electrical contact; and in that the electrical contact is a butt contact in the inside space of the cover, wherein the first connection member comprises a distal body movable along the longitudinal axis, the distal body comprises an electrical contact element composed of electrical contacts, each electrical contacts being mounted on an internal spring in order to ensure the butt contact, and wherein the device comprises a spring, the distal body being pressed against the spring, the method comprising the following steps:

starting from the closed position of the lighting device, electrically disconnecting the first and second connection members by opening the closure member of the first end;

removing the light source support from the inside space;

performing maintenance, assembly or adjustment on the light source and/or on the light source support;

putting the light source support and the light source back into the inside space; and electrically connecting the first and second connection members together by closing the closure member.

9. A method of acting on a lighting device according to claim 8, further including a step of guiding and of magnetically attracting a second connection member secured to the closure member relative to the first connection member secured to the light source support inside the cover.

10. A method of acting on a lighting device comprising:

a light source;

a light source support, to which the light source is fastened;

a cover that extends longitudinally along a longitudinal axis between a first end and a second end, said cover defining an inside space, said light source support and said light source being arranged in the inside space, and each of the first and second ends having a respective opening, the light source support being adapted to be moved in part or in full out from the inside space through a said opening;

a closure member for closing at least one of the openings at the first and second ends, the closure member being movable between a closed position in which the closure member closes the opening, and an open position in which the closure member does not close the opening; and a connector having a first connection member and a second connection member;

the device being characterized in that the first connection member is arranged in the inside space and the second connection member is provided on the closure member of the first end;

in that in the closed position of the closure member, the first and second connection members are electrically connected together by an electrical contact; and in that the electrical contact is a butt contact in the inside space of the cover, wherein the first connection member comprises a distal body movable along the longitudinal axis, the distal body comprises an electrical contact element composed of electrical contacts, each electrical contacts being mounted on an internal spring in order to ensure the butt contact, and wherein the device comprises a spring, the distal body being pressed against the spring, the method comprising the following steps:

starting from the closed position of the lighting device, opening the closure member of the second end and electrically disconnecting the first and second connection members by moving the light source support in part or in full out from the inside space through the opening of the second end;

performing maintenance, assembly or adjustment on the light source and/or on the light source support;

putting the light source support and the light source back into the inside space;

electrically connecting the first and second connection members together by putting the light source support and the light source into position in the inside space; and closing the closure member of the second end.

* * * * *